US009851083B2

(12) United States Patent
Pinilla

(10) Patent No.: US 9,851,083 B2
(45) Date of Patent: Dec. 26, 2017

(54) INTEGRATED FIREARM ACCESSORY PLATFORM

(71) Applicant: Christian John Pinilla, Farmers Branch, TX (US)

(72) Inventor: Christian John Pinilla, Farmers Branch, TX (US)

(73) Assignee: Scalpel Arms, LLC, Dallas, TX (US)

( * ) Notice: Subject to any disclaimer, the term of this patent is extended or adjusted under 35 U.S.C. 154(b) by 0 days.

(21) Appl. No.: 15/228,851

(22) Filed: Aug. 4, 2016

(65) Prior Publication Data

US 2017/0038178 A1 Feb. 9, 2017

Related U.S. Application Data

(60) Provisional application No. 62/200,877, filed on Aug. 4, 2015.

(51) Int. Cl.

| | |
|---|---|
| ***F41C 23/16*** | (2006.01) |
| ***F21V 23/04*** | (2006.01) |
| ***F41G 11/00*** | (2006.01) |
| ***F41C 23/22*** | (2006.01) |

(52) U.S. Cl.

CPC ..... *F21V 23/0414* (2013.01); *F41C 23/16* (2013.01); *F41C 23/22* (2013.01); *F41G 11/003* (2013.01)

(58) Field of Classification Search

CPC ..... F41C 23/16; F41V 23/04; F41V 23/0435; F41V 23/0442; F41V 23/045; F41V 23/0464; F41V 23/0485

USPC ..... 42/114, 115, 117, 142, 146

See application file for complete search history.

(56) References Cited

U.S. PATENT DOCUMENTS

| | | | | |
|---|---|---|---|---|
| 5,704,155 | A | 1/1998 | Primeau, IV | |
| 6,671,990 | B1 * | 1/2004 | Booth | F41C 23/16 42/75.01 |
| 7,216,451 | B1 * | 5/2007 | Troy | F41C 23/16 42/71.01 |
| 7,954,273 | B1 | 6/2011 | Swan | |
| 8,459,822 | B1 * | 6/2013 | Lambert | F41G 1/35 362/110 |
| 8,695,267 | B2 | 4/2014 | Houde-Walter | |
| 9,250,040 | B1 | 2/2016 | Bird et al. | |
| D752,169 | S | 3/2016 | Merlino et al. | |

(Continued)

*Primary Examiner* — Stephen Johnson

(74) *Attorney, Agent, or Firm* — Braxton, Hilton & Perrone, PLLC

(57) ABSTRACT

An integrated firearm accessory platform for mounting within and being secured to a firearm handguard. A forward assembly of the platform has an opening formed within, allowing for the passage of a firearm barrel. Apertures formed on a forward face of the forward assembly are sized to receive firearm accessories such as LED light sources, the apertures causing the LED light sources to be directed in a forward facing direction. The forward face of the forward assembly does not protrude from the firearm handguard, and the platform is sized to leave little space between it and the firearm handguard, giving the platform the appearance that it is an integral part of the handguard or overall firearm. The at least partial enclosure of the platform within the firearm handguard protects the platform from damage caused by objects that may be snagged on the platform.

11 Claims, 4 Drawing Sheets

(56) References Cited

U.S. PATENT DOCUMENTS

| | | | | |
|---|---|---|---|---|
| 2015/0247700 | A1 | 9/2015 | Merlino et al. | |
| 2016/0061560 | A1 * | 3/2016 | Saadon | F41G 11/003 42/72 |

* cited by examiner

INTEGRATED FIREARM ACCESSORY PLATFORM

CROSS REFERENCE TO RELATED APPLICATIONS

This application claims the benefit of U.S. Provisional Application No. 62/200,877, filed on Aug. 4, 2015, the teaching of which is incorporated by reference herein.

BACKGROUND OF THE INVENTION

Technical Field

The present invention relates generally to firearms accessories and more specifically, to a firearm accessory platform mountable around a firearm barrel, said accessory platform being mounted at least partially within a firearm handguard.

Description of Related Art

The use of light sources in conjunction with firearms is known in the art. For centuries, hunters and combatants using firearms under the cover of darkness had to rely on natural sources of light (for example, the Moon), as well as their own senses, to correctly identify and aim at targeted objects. As electrical lighting technology progressed over the years, firearms users began to utilize spotlights, flashlights and other light sources to assist them in illuminating targeted objects. In many cases, a user of a firearm was required to hold the electrical lighting device while also holding, aiming, and firing the firearm. Attempts of this nature often proved unsatisfactory and in the case of such use in combat, dangerous. In other cases, the lighting device might be mounted on a platform (for example, a tripod type device) capable of aiming the light source at a targeted object while the firearm user operated his or her firearm. In other cases, another person might be utilized to hold and aim the firearm while the firearm user aimed and fired the firearm. While relieving the firearms user of the responsibility of holding and aiming the lighting device, such prior art methods were inefficient.

As the physical size and weight of electrical lighting devices became smaller over time, primarily as a result of technological advances in the miniaturization of electrical circuit components, as well as other advances in batteries, materials used for component housing, and lighting emitting devices (for example, light-emitting diodes or "LEDs"), it became feasible to construct lighting devices for mounting directly onto firearms. For example, some prior art lighting devices are configured for mounting onto an exterior firearm grip, trigger guard, or frame. Other prior art lighting devices are configured for mounting onto an exterior surface of a firearm handguard through use of a separate or integrated mounting accessory configured to mate with a correspondingly shaped rail or mounting aperture formed on a firearm handguard.

Such prior art lighting devices configured for mounting on the exterior of a firearm offer some advantages. For example, such devices make it possible for a firearms user to utilize a lighting device without the assistance of another person, without requiring the firearm user to both aim the lighting device and the firearm, allowing the user to control both the direction of the firearm muzzle and direction of illumination at the same time. However, there are many drawbacks and other limitations inherent in such prior art lighting devices and the means by which they are mounted to firearms. A primary drawback of such prior art systems is that they act as an object that can easily snag on or become entangled with other objects, causing the user to be impeded in movement and potentially causing inadvertent disruptions in the act of aiming and/or firing of the firearm. Another drawback of such prior art lighting devices configured for mounting on the exterior of a firearm is that they are at greater risk of being damaged due to being struck or being ripped off of the firearm. Another drawback of such prior art lighting devices configured for mounting on the exterior of a firearm is that they are at greater risk of being damaged due to being more fully exposed to environmental hazards such as water.

Accordingly, a long-felt but unaddressed need in the prior art is for a firearm accessory platform having a light source assembly (or other accessory assembly) mountable at least partially within an enclosure defined by a firearm handguard. Another long-felt but unaddressed need in the prior art is for such an accessory platform that is configured such that only minimal modifications need to be made to existing firearms handguards to permit for the mounting of the device within the handguard. As described in further detail below, the inventions disclosed herein provide these and other long-felt but unmet needs in the art.

BRIEF DESCRIPTION OF THE SEVERAL VIEWS OF THE DRAWINGS

The novel features believed characteristic of the inventions are set forth in the appended claims. The inventions themselves, however, as well as preferred modes of use, further advantages thereof, will be best understood by reference to the following detailed description of illustrative embodiments when read in conjunction with the accompanying drawings, wherein:

Figure 1:
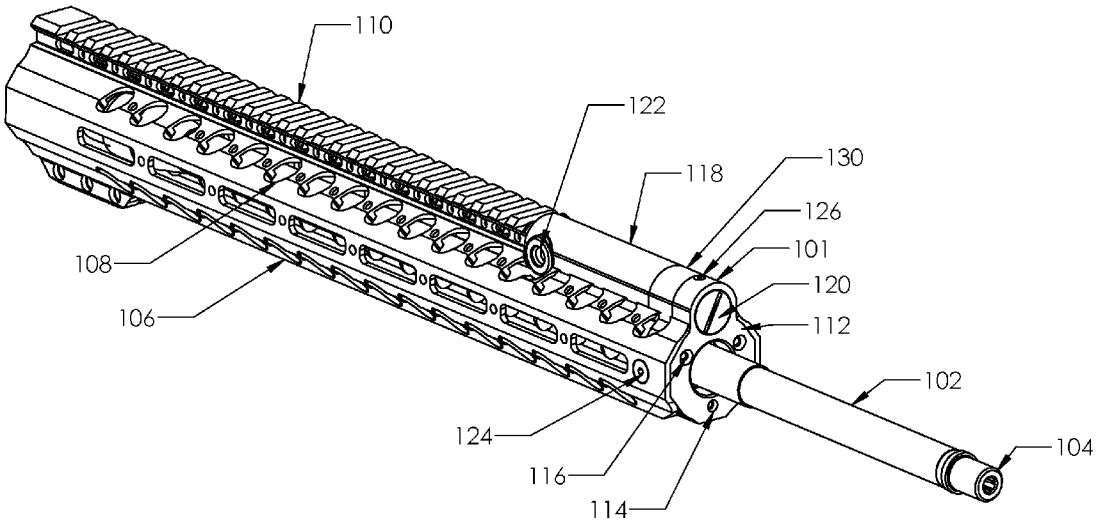
FIG. 1 is a perspective view of a portion of AR-15 type firearm upper receiver assembly having an embodiment of the lighting platform device mounted within a handguard of said upper receiver assembly.

Where used in the various figures of the drawings, the same reference numerals designate the same or similar parts. All figures are drawn for ease of explanation of the basic teachings of the invention only; the extensions of the figures with respect to number, position, relationship, and dimensions of the parts to form the preferred embodiment will either be explained or will be within the skill of persons of ordinary skill in the art after the following teachings of the present invention have been read and understood.

DETAILED DESCRIPTION OF THE DRAWINGS

Several embodiments of Applicant's invention(s) will now be described with reference to the drawings. Unless otherwise noted, like elements will be identified by identical numbers throughout all figures. The invention(s) illustratively disclosed herein suitably may be practiced in the absence of any element that is not specifically disclosed herein and, unless otherwise explicitly noted, may be practiced in the absence of other elements disclosed herein.

Accessory platforms configured for mounting on a firearm are disclosed herein. It should be noted that while the exemplary embodiments of the firearm accessory platform devices discussed herein are associated with housing electrical light sources such as bulb, LED, and laser assemblies and associated electrical components, it is contemplated herein that the devices discussed herein could also be equally utilized to serve as a mounting platform for other types of accessories that may be utilized in conjunction with a firearm. Non-limiting examples of such other accessories that may be mounted within an embodiment of the present invention include, but are not be limited to, rangefinder(s), infrared illuminator(s), camera(s), image sensor(s), alternate lethal and/or non-lethal projectile(s)/measure(s), and associated mechanisms for deploying such projectiles/measures. Moreover, it should further be noted that while embodiments of the platform device taught herein are discussed and illustrated as being used in conjunction with an AR-15 style rifle, it is contemplated that other embodiments of the platform device may equally be used in conjunction with other types of firearms and firearm styles/brands, often with only minor modifications to the design that would be recognized by those skilled in the art.

Referring to FIG. 1, a perspective view of a forward portion of AR-15 style firearm upper receiver assembly having an embodiment of the firearm accessory platform (101) that is at least partially mounted within a handguard (106) of said upper receiver assembly such that a forward portion of the firearm barrel (102) passes through a hole formed through the accessory platform (101), and further such that a portion of the platform is enclosed within the inner walls of the firearm handguard. It should be noted that the terms "enclose," "enclosed," and "enclosure" as used herein are not intended to solely connote a fully sealed barrier, but rather also is intended to encompass the type of surrounding barrier that includes openings at one or more ends, as well as one or more openings in the barrier. For example, the firearm handguard (106) shown in FIG. 1, having openings at both ends and multiple openings (108) throughout, is referred to herein as an enclosure in that it at least partially encloses the firearm accessory platform at the forward end of the handguard.

Still referring to FIG. 1, in one embodiment the firearm accessory platform comprises a first forward assembly (112) and second forward assembly (130) that are connected by a fastener (for example, a screw (126)) and together house a light source. It should be noted that in other alternate embodiments of the firearm accessory platform, the light source(s) or other firearm accessory may be housed in one or more forward assemblies that may or may not be connected either with a fastener, integrally connected, or otherwise connected. In the embodiment of the platform shown in FIG. 1, the light source comprises multiple light emitting diodes (LEDs) secured by a semi-circular shaped board (shown in FIG. 2) mounted within the first and second forward assemblies (112, 130). Apertures (114) formed on the first forward assembly allow for the partial or full protrusion of the LEDs, and further allow for the transmission of light forward from the front portion of the firearm adjacent to the firearm muzzle (104). The utilization of lenses in addition to the lenses found on the LEDs may be used in conjunction with the LEDs (or other light sources) in alternate embodiments of the platform. In an alternate embodiment, such lenses may be located and secured to the apertures (114) through which light is transmitted.

Still referring to FIG. 1, and as noted above, holes formed in the first forward assembly and second forward assembly allow for the passage of the firearm barrel (102). The bottom portions of the first and second forward assembly are partially enclosed by the firearm handguard. A forward face of the first forward assembly (112) is not enclosed by the handguard (in that it is exposed through an opening in the handguard) but does not protrude from the end of the forward portion of the handguard. Top portions of the first and second forward assemblies, in one embodiment of the platform, include holes for the insertion and removal of one or more batteries used to power the LEDs. In one embodiment, such top portions of the first and second forward assemblies are not enclosed within the handguard. In the embodiment of the platform shown in FIG. 1, the second forward assembly (130) is connected to a rear assembly (118) that is configured to protrude from the top of the forward portion of the handguard, and further configured to house one or more batteries, and further house electrical components associated with circuitry controlling and powering the LEDs.

In this embodiment shown at FIG. 1, neither the rear assembly, nor the top portions of the first and second forward assemblies, protrude above a plane defined by the top surfaces of an accessory rail (110) mounted to the top of the handguard. While in some embodiments, the top of the platform may protrude slightly above a rail or handguard, it is preferred that any such protrusion not interfere with the mounting and operation of other firearm accessories that may also be mounted to the firearm such as, for example, firearm optics, iron sights, other light source platforms (for example, lasers and associated mounting devices), cameras, or rangefinders. In some alternate embodiments, the rear assembly may protrude through a bottom or side opening in the handguard. In even other alternate embodiments, the rear assembly may be disposed within the handguard such that no portion of the platform protrudes outside of the handguard. In one embodiment,an opening formed in the rear assembly provides for passage, via an insert (122) mounted within said opening, of a wire associated with a switch controlling the operation of the LEDs, said switch being connected to, for example, a user-controlled pressure sensor (not shown) secured to the firearm at a separate location (for example, adjacent to the grip, trigger, or lower receiver assembly).

Still referring to FIG. 1, fasteners are used to removably secure the platform to the handguard. In the embodiment of the platform shown, two screws (124, 125) sized to pass through holes in the handguard and correspondingly sized threaded holes formed in the second forward assembly, are used to secure the platform to the handguard. Those of skill in the art will recognize that the platform may be secured to the handguard using other types of fasteners and/or other types of means of securing or mounting the platform to the handguard. Likewise, while the material used to construct the forward and rear assemblies of the platform (not including electrical components) shown in the embodiment shown in FIG. 1 is aluminum, those of skill in the art will recognize that other types of heat-resistant materials (for example, polymers, other metals, composites, carbon fiber, etc.) may be equally suited and utilized as materials for constructing the assemblies of the platform discussed herein.

Figure 2:
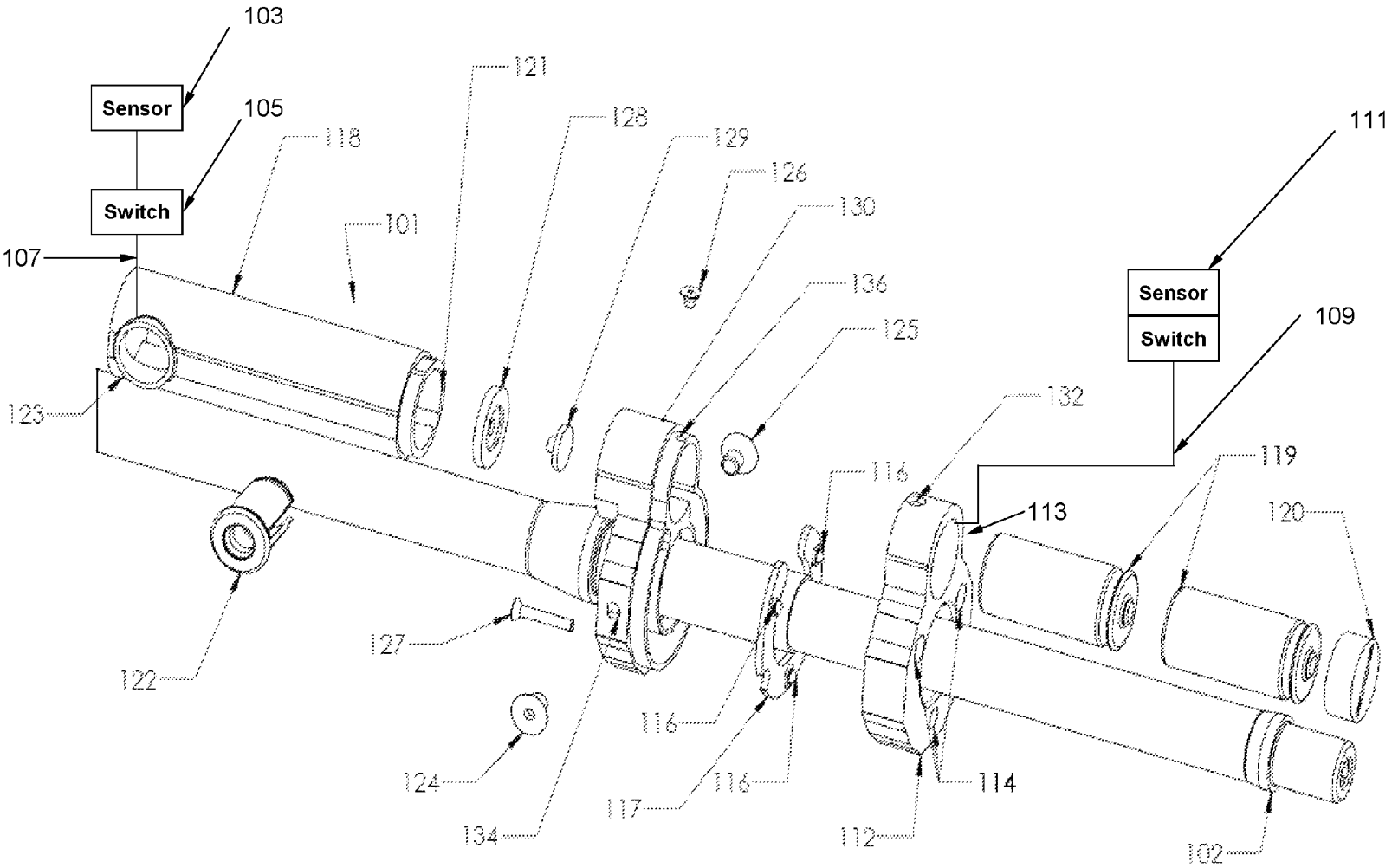
FIG. 2 is an exploded view of the embodiment of the lighting platform device as shown in FIG. 1, said lighting platform device (101) configured to mount around a distal end of a firearm barrel (102)

Referring now to FIG. 2, an exploded view of the embodiment of the firearm accessory platform as shown in FIG. 1, said platform (101) is configured to mount around a distal end of a firearm barrel (102). The first forward assembly (112) is shaped to interconnect with the second forward assembly (130), the two assemblies being secured together by a screw (126) that is sized to pass through correspondingly sized holes (132, 136) in the top portions of each of the assemblies, and a second screw (127) that passes through the bottom portions of the forward assemblies. LEDs (116) are mounted to a semi-circular board (117) that is mounted between the two forward assemblies, the lenses of the LEDs being positioned to partially pass through apertures (114) formed on the first forward assembly. It should be noted that other configurations for securing the LEDs or other firearm accessories within the platform may be utilized in alternate embodiments of the platform.

Not shown in the drawings are wiring and other electrical circuitry that those of ordinary skill in the art will recognize as being necessary for the control and powering of the LEDs utilized in this embodiment as a light source. Those of skill in the art will recognize that the positioning of such wiring and other electrical components within the platform is at the discretion of the commercial embodiment of the platform and is not essential to the use of the platform. In one embodiment, batteries (119) are used as a portable source of power for the LED circuit, the batteries sized to be housed within the rear assembly (118). The platform is configured to allow for the insertion of the batteries through holes formed on the top portions of the first and second forward assemblies. A threaded cap (120) having a notch formed on a forward face thereof is intended to allow a user to easily open or close access to the battery compartment formed within the rear assembly (118), said battery compartment including components (128, 129) of a battery compartment assembly. In one embodiment, an opening (123) is formed in the rearward portion of the rear assembly (118) of the platform, said opening sized to receive an insert (122) used to accept a wire (107) connected to a user-controlled pressure sensor (103) connected to a switch (105) for controlling the illumination of the LEDs. In alternate embodiments of the platform, an opening (113) could be formed in a forward assembly to allow passage of a wire (109) from a user-controlled pressure sensor/switch (111), to control operation of the firearm accessories.

Figure 3:
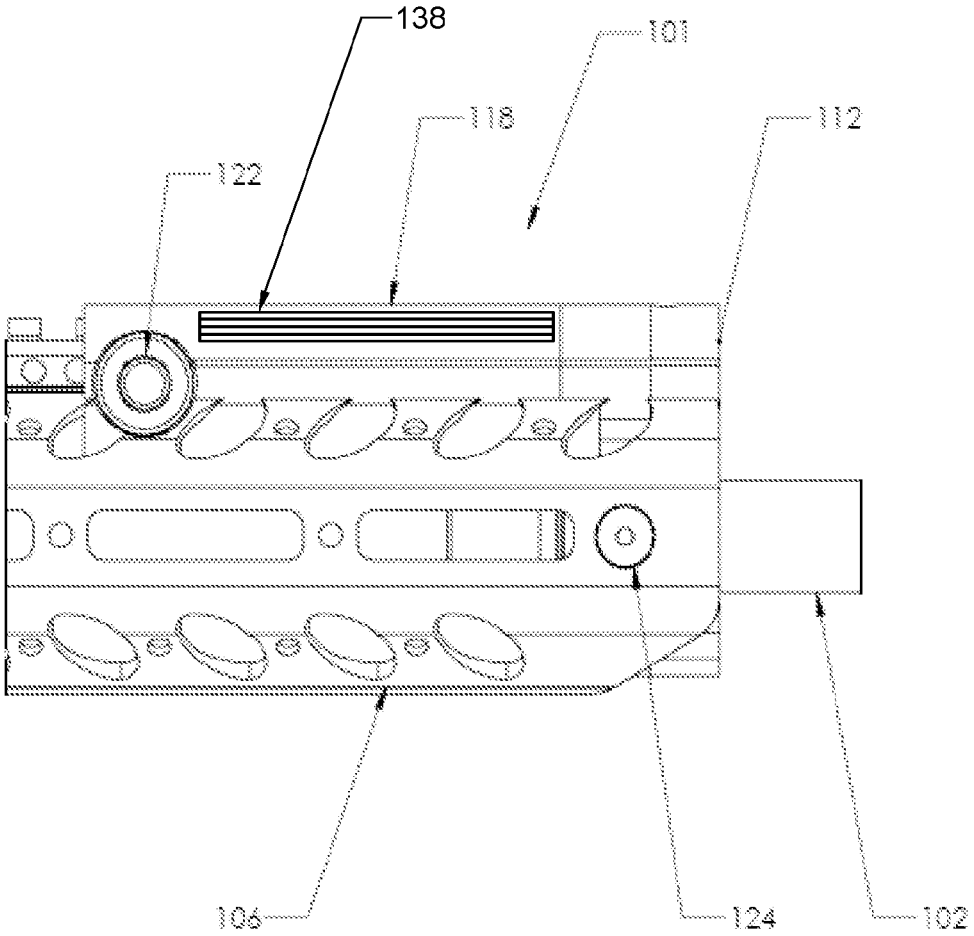
FIG. 3 is a side view of the embodiment of the lighting platform device as shown in FIG. 1, said lighting platform device (101) configured to mount around a distal end of a firearm barrel (102)

Referring now to FIG. 3, a side view of the embodiment of the firearm accessory platform (101) as shown in FIG. 1, said accessory platform (101) configured to mount around a distal end of a firearm barrel (102) and be at least partially enclosed within a firearm handguard (106). Shown in FIG. 3 is a screw (124) used to secure the platform to the firearm handguard (106). In one embodiment, the first forward assembly (112) does not protrude from the forward most end of the firearm handguard (106). This provides one advantage over prior art accessory platforms in that it reduces the risk that a portion of the platform will be damaged due to being exposed, and further provides an aesthetic advantage in that the platform appears to be integral to the handguard, and not merely an attachment to the handguard. It is contemplated that in some alternate embodiments, the forward assembly may protrude from the forward most end of the handguard. The rearward assembly and the top portions of the first and second forward assemblies protrude from the top of the handguard. This protrusion from the top of the handguard also provides for an advantage over prior art mounting platforms in that it provides for easy access by a user to insert and remove batteries without it being necessary to either remove the platform from the firearm, or disassemble the handguard. In some embodiments of the platform, such as the embodiment shown in FIG. 3, solar cells (138) may be mounted to the top of the platform, and be connected to necessary circuitry for utilizing such solar cells (138), to serve as a primary or secondary power source for the LED circuit or other electrically-powered firearm accessory.

As noted above, alternate embodiments of the platform may be configured to fully enclose the platform within the handguard (with the exception of the forward end of the platform). In such an alternate embodiment, a cap or lid may be positioned on the forward face of the first forward assembly, removable by a user, to easily gain access to a battery compartment. Such a cap or lid could be opened, for example, by a spring mechanism or secured by threaded engagement. Those of ordinary skill in the art will recognize that various structures and mechanisms may be used to secure a battery compartment.

Figure 4:
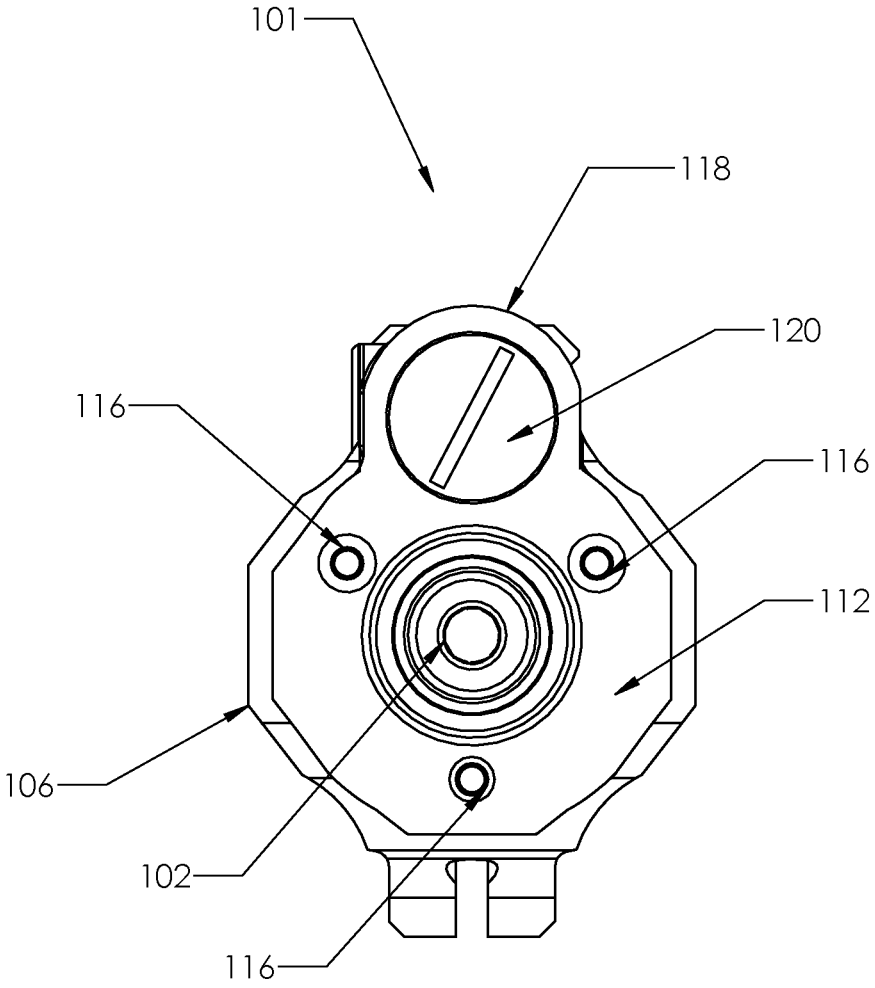
FIG. 4 is a front view of the embodiment of the lighting platform device as shown in FIG. 1, said lighting platform device (101) configured to mount around a distal end of a firearm barrel (102).

Referring now to FIG. 4, a front view of the embodiment of the firearm accessory platform as shown in FIG. 1, said firearm accessory platform (101) configured to mount around a forward end of a firearm barrel (102). In this embodiment of the platform, apertures formed on the first forward assembly (112) allow for the partial protrusion of the LEDs, said apertures being spaced around the barrel and configured to allow for the forward transmission of light in the same direction as the direction of fire. This provides another advantage over prior art accessory platforms in that the accessory may be pointed precisely in the direction of the direction of fire. Although three LEDs appear in the platform appearing in the drawings discussed herein, alternate embodiments may utilize any number of LEDs or other light sources.

Still referring to FIG. 4, the forward assemblies of the platform are sized to precisely fit within the handguard, allowing for very little space between the exterior surfaces of the assemblies, and the inner surfaces of the handguard. As noted above, this provides an aesthetic advantage over prior art platforms in that such a configuration gives the appearance of the platform being integral to the handguard and/or the overall firearm.

It should be noted that the description of the present invention has been presented for purposes of illustration and description, and is not intended to be exhaustive or limited to the invention in the form disclosed. Many modifications and variations will be apparent to those of ordinary skill in the art. The preferred embodiment appearing in the drawings was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims. Moreover, it should be noted that uses of the phrase "the present invention" within this disclosure are not intended to limit or otherwise restrict the scope of the invention(s) disclosed and claimed by the inventor, but said phrase is merely intended to refer to certain examples of embodiments of the invention(s).

What is claimed is:

1. A firearm accessory platform comprising:

a forward assembly for mounting one or more firearm accessories therein, said forward assembly having a first hole for passage of a firearm barrel;

wherein said forward assembly includes a bottom portion and a top portion, said bottom portion of said forward assembly having a forward face having one or more apertures formed thereon around said hole, a portion of each of said one or more firearm accessories disposed within said one or more apertures; and wherein one or more fasteners secure at least said bottom portion of said forward assembly inside a firearm handguard.

2. The firearm accessory platform of claim 1, further comprising a rear assembly connected to said forward assembly, said rear assembly extending rearward along said barrel.

3. The firearm accessory platform of claim 2, wherein at least a portion of said rear assembly protrudes from an opening in a top of said handguard.

4. The firearm accessory platform of claim 1, wherein said each of said one or more firearm accessories is a light source.

5. The firearm accessory platform of claim 1, wherein said forward face of said forward assembly does not protrude from a forward end of said firearm handguard.

6. The firearm accessory platform of claim 1, wherein a first opening is formed on a portion of said forward assembly, said rear assembly having a second opening formed on a forward portion thereof, said first opening and second opening provide for the passage of one or more batteries to said rear assembly.

7. The firearm accessory platform of claim 6, further comprising a removable cap to seal said first opening formed on said forward assembly.

8. The firearm accessory platform of claim 2, wherein a second hole is formed on said rear assembly, said second hole being sized to receive a wire from a user-controlled sensor, said sensor connected to a switch for operating said one or more firearm accessories.

9. The firearm accessory platform of claim 1, wherein a second hole is formed on said forward assembly, said second hole being sized to receive a wire from a user-controlled sensor, said sensor connected to a switch for operating said one or more firearm accessories.

10. The firearm accessory platform of claim 1, wherein said top portion of said forward assembly at least partially protrudes from said firearm handguard.

11. A firearm accessory platform comprising:

a forward assembly for mounting one or more firearm accessories therein, said forward assembly having a first hole for passage of a firearm barrel;

wherein said forward assembly includes a bottom portion and a top portion, said bottom portion of said forward assembly having a forward face having one or more apertures formed thereon around said hole, a portion of each of said one or more firearm accessories disposed within said one or more apertures;

wherein one or more fasteners secure at least said bottom portion of said forward assembly inside a firearm handguard;

wherein at least a portion of a rear assembly protrudes from an opening in a top of said handguard, said rear assembly connected to said forward assembly and extending rearward along said barrel; and wherein one or more solar cells are mounted on a top surface of said rear assembly, said solar cells used as a power source for said firearms accessories.

* * * * *